US010392166B2

(12) United States Patent
Skillin et al.

(10) Patent No.: US 10,392,166 B2
(45) Date of Patent: Aug. 27, 2019

(54) SQUIRT DISPENSING CLOSURE FOR LIQUID DRINK CONCENTRATE

(71) Applicant: SILGAN DISPENSING SYSTEMS SLATERSVILLE LLC, Slatersville, RI (US)

(72) Inventors: Clifford W. Skillin, Blackstone, MA (US); Patrick J. Brannon, Warwick, RI (US); Sergey Romanov, Cranston, RI (US); Gordana K. Giguere, North Smithfield, RI (US); Vincent J. DeSanto, Lincoln, RI (US)

(73) Assignee: Silgan Dispensing Systems Slatersville LLC, Slatersville, RI (US)

( * ) Notice: Subject to any disclaimer, the term of this patent is extended or adjusted under 35 U.S.C. 154(b) by 18 days.

(21) Appl. No.: 15/558,919

(22) PCT Filed: Mar. 14, 2016

(86) PCT No.: PCT/US2016/022256

§ 371 (c)(1),
(2) Date: Sep. 15, 2017

(87) PCT Pub. No.: WO2016/149166

PCT Pub. Date: Sep. 22, 2016

(65) Prior Publication Data

US 2018/0072470 A1 Mar. 15, 2018

Related U.S. Application Data

(60) Provisional application No. 62/135,468, filed on Mar. 19, 2015.

(51) Int. Cl.

| | |
|---|---|
| ***B65D 47/04*** | (2006.01) |
| ***B65D 47/08*** | (2006.01) |
| ***B67D 3/00*** | (2006.01) |

(52) U.S. Cl.
CPC ..... *B65D 47/0838* (2013.01); *B65D 47/043* (2013.01); *B67D 3/00* (2013.01)

(58) Field of Classification Search
CPC .. B65D 88/64; B65D 47/043; B65D 47/0838; B65D 47/40; B65D 47/06; B67D 3/0051; A47K 5/1202; G01F 13/006
(Continued)

(56) References Cited

U.S. PATENT DOCUMENTS

| | | | | |
|---|---|---|---|---|
| 1,914,766 A | | 6/1933 | Zaloschan | |
| 3,739,938 A | * | 6/1973 | Paz | A47G 19/2272 215/309 |

(Continued)

*Primary Examiner* — Paul R Durand
*Assistant Examiner* — Robert K Nichols, II
(74) *Attorney, Agent, or Firm* — Barlow, Josephs & Holmes, Ltd.

(57) ABSTRACT

A squirt dispensing closure (10) for liquid drink flavor concentrate includes a closure body (12), a hinged cap (14), and a flow baffle (18). The closure body has a closure deck (20) and a tubular dispensing spout (22) having a lower portion (26) extending downwardly to provide a flow conduit (28) from the interior of the closure body. The flow baffle (18) includes a bottom wall (40), and a side wall (42) which is snap mounted over the lower portion of the dispensing spout (22). A fluid well (50) is formed in the bottom wall (40) and a fluid opening (52) is formed on a peripheral edge of the bottom wall. An arcuate baffling wall (54) extends upwardly from the bottom wall (40) adjacent the fluid opening (52), forming a restricted flow gap (56) from the fluid opening into an interior of the flow baffle (18). A baffling post (58) extends upwardly from within the fluid well 50) into the flow conduit (28) to form a restricted annular flow passage (60) therebetween.

17 Claims, 10 Drawing Sheets

(58) Field of Classification Search
USPC ..... 222/547, 564, 212, 109
See application file for complete search history.

(56) References Cited

U.S. PATENT DOCUMENTS

| | | | | |
|---|---|---|---|---|
| 4,460,101 | A * | 7/1984 | Tseng | B65D 51/24 215/307 |
| 4,811,871 | A * | 3/1989 | Wass | B67C 9/00 222/212 |
| 5,320,254 | A * | 6/1994 | Ranalletta | B05B 11/0021 222/189.08 |
| 9,625,299 | B2 * | 4/2017 | Holden | G01F 11/268 |
| 2003/0042272 | A1 | 3/2003 | Rousselet et al. | |
| 2010/0072231 | A1 * | 3/2010 | Bloom | B65D 47/06 222/547 |
| 2011/0198371 | A1 | 8/2011 | Law et al. | |
| 2012/0305599 | A1 | 12/2012 | Painchaud et al. | |

* cited by examiner

SQUIRT DISPENSING CLOSURE FOR LIQUID DRINK CONCENTRATE

BACKGROUND OF THE INVENTION

(1) Field of the Invention

The instant invention relates to dispensing closures and more particularly to a squirt-type dispensing closure for dispensing a steam of liquid drink flavor concentrate.

(2) Description of Related Art

The product category of liquid drink flavor concentrates continues to grow each year. There is a need in the industry for improved dispensing closures to cleanly and effectively dispense the drink flavor concentrate from small squeeze containers.

SUMMARY OF THE INVENTION

A squirt dispensing closure for liquid drink flavor concentrate includes a closure body, a cap, a hinge structure connecting the cap to the closure body, and a flow baffle which improves a clean, high-velocity squirt dispensing of the product from a flexible squirt-type container.

The closure body has a closure deck and a tubular dispensing spout having an upper portion extending upwardly from the closure deck and a lower portion extending downwardly from the closure deck. The tubular dispensing spout provides a flow conduit from the interior of the closure body to an exterior thereof.

An inner skirt wall extends downwardly from the closure deck encircling the lower portion of the dispensing spout and provides container mounting formations, which may be threads or thread lugs for engagement with corresponding threads on the outer surface of the neck of the squirt container.

An outer decorative skirt wall extends downwardly from the closure deck. The outer skirt may be shaped and adapted to match the outer shape of the squirt container to form a continuous outer surface with the container.

The cap may be connected to the closure body by a living hinge structure which is integrally formed with the cap and the closure body. Accordingly, it can be appreciated that the cap is movable between open and closed positions. The wall of the cap may also be shaped and adapted to match the outer shape of the squirt container and outer skirt to form a continuous outer surface. To provide a seal with the upper portion of the dispensing spout, the cap includes a tubular sealing bead which is snap received over the upper portion of said dispensing spout to seal the container closed.

The flow baffle is mounted to the bottom of the closure deck and includes a bottom wall, and a side wall having a peripheral upper edge which is snap received with an annular shoulder surrounding the lower portion of the dispensing spout.

A fluid well is formed in the center of the bottom wall and a fluid opening is formed on a peripheral edge of the bottom wall. An arcuate baffling wall extends upwardly from the bottom wall in closely spaced facing relation with the side wall and adjacent the fluid opening and forms an arcuate, restricted flow gap from the fluid opening into an interior of the flow baffle. Additionally, a baffling post extends upwardly from within the fluid well into the flow conduit in the lower portion of the dispensing spout to form a further restricted annular flow passage therebetween.

The highly restricted flow path from the interior of the container through the upper portion of the dispensing spout and provides a high velocity squirt dispense of the liquid when the container is inverted and squeezed while also providing a clean, no-drip stop of flow when pressure is removed from the container.

BRIEF DESCRIPTION OF THE DRAWINGS

While the specification concludes with claims particularly pointing out and distinctly claiming particular embodiments of the instant invention, various embodiments of the invention can be more readily understood and appreciated from the following descriptions of various embodiments of the invention when read in conjunction with the accompanying drawings in which:

DETAILED DESCRIPTION OF THE INVENTION

Figure 1:
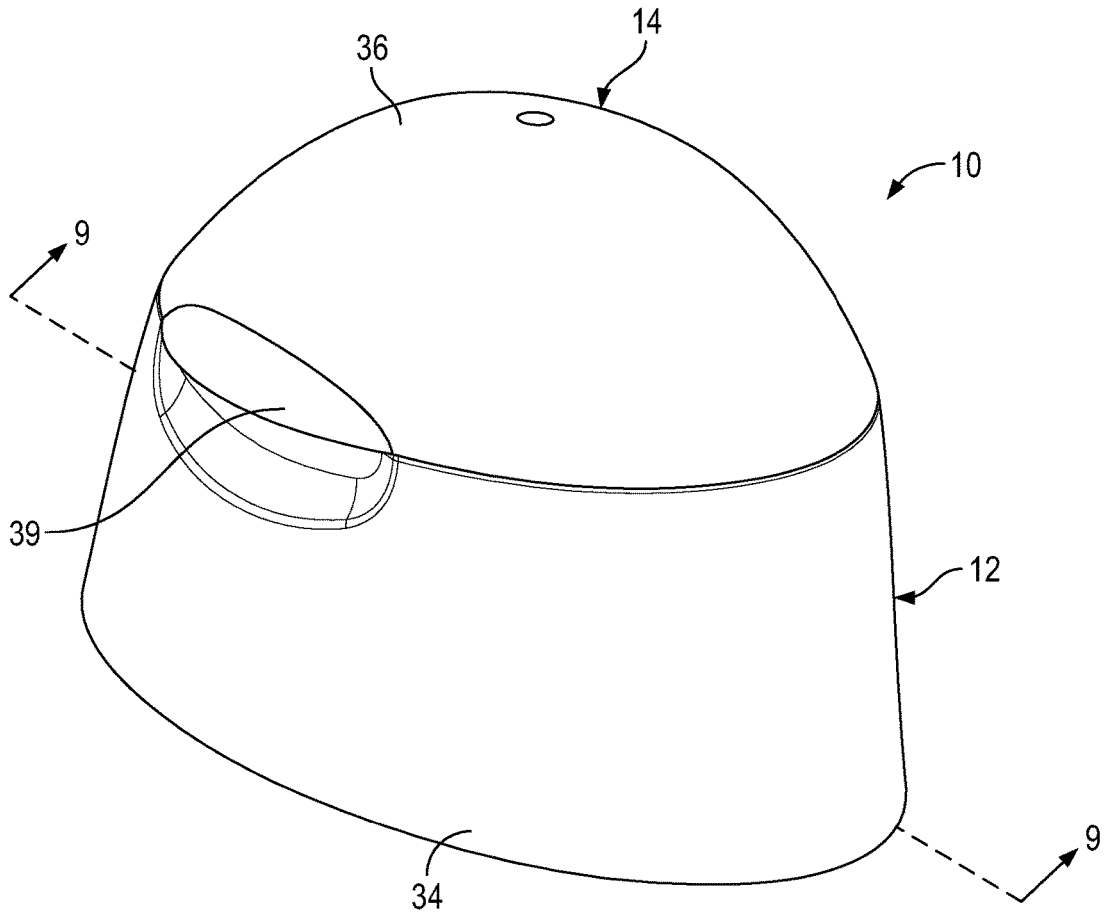
FIG. 1 is a perspective view of an exemplary embodiment.
Figure 2:
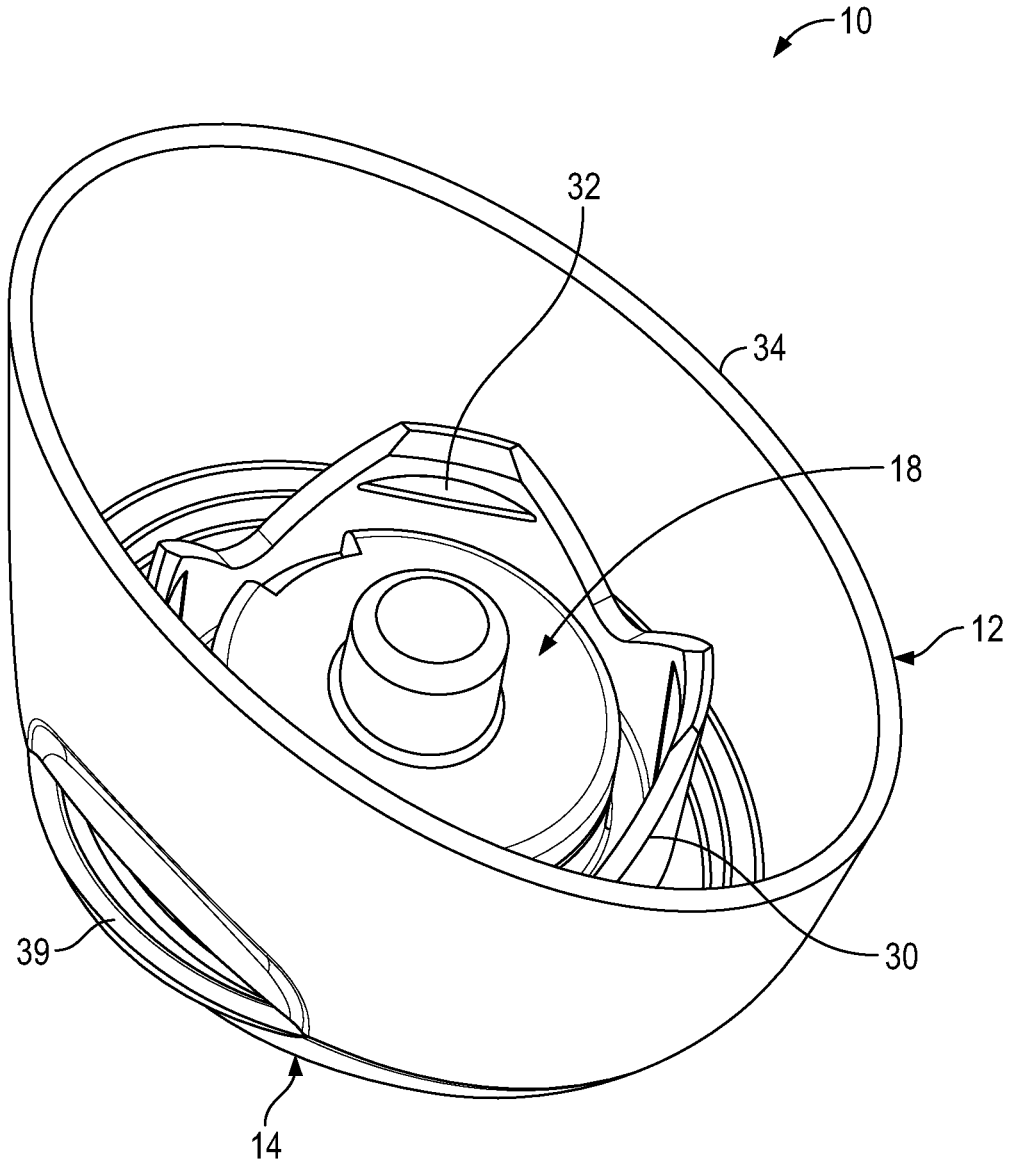
FIG. 2 is a bottom perspective view thereof.

Referring now to the drawings, an exemplary embodiment of the dispensing closure is generally indicated at 10 in FIGS. 1-10. The squirt dispensing closure 10 is particularly suited for dispensing liquid drink flavor concentrate, but may be used for any squirtable liquid.

The dispensing closure 10 generally includes a closure body 12, a cap 14, a hinge structure 16 connecting the cap 14 to the closure body 12, and a flow baffle 18 which improves a clean, high-velocity squirt dispensing of the product from a flexible, squirt-type container (not shown).

The closure 10 and container may both be formed from plastic materials.

However, the container may alternatively be formed from a foil pouch material, or any other suitable flexible material which can be squeezed to provide pressure within the interior of the container.

The closure body 12 includes a closure deck 20 and a tubular dispensing spout 22 having an upper portion 24 extending upwardly from the closure deck 20 and a lower portion 26 extending downwardly from the closure deck 20. The tubular dispensing spout 22 provides a continuous flow conduit 28 from the interior of the closure body 12 to an exterior thereof. The dispensing spout 22 may alternatively exclude the upper portion 24 thereof and provide a direct dispense from the flow conduit 28 exiting directly at the surface of the closure deck 20.

An inner skirt wall 30 extends downwardly from the closure deck 20 encircling the lower portion 26 of the dispensing spout 22 and provides container mounting formations 32, which may be threads or thread lugs for engagement with corresponding threads on the outer surface of the neck of the squirt container. In the exemplary embodiment as illustrated, the inner skirt wall 30 is segmented and includes thread lugs 32.

An outer decorative skirt wall 34 extends downwardly from the closure deck 20. The outer skirt wall 34 may be shaped and adapted to match the outer shape of the squirt container to form a continuous outer surface with the container. Alternatively, the closure body 12 may be formed without the outer skirt wall 34 when it is not needed.

The cap 14 may be connected to the closure body 12 by a living hinge structure 16 which is integrally formed with the cap 14 and the closure body 12. Accordingly, it can be appreciated that the cap 14 is movable between open and closed positions (See FIGS. 1 and 3). The cap wall 36 may be shaped and adapted to match the outer shape of the squirt container and outer skirt wall 34 to form a continuous outer surface. In the exemplary embodiment as illustrated, the cap wall 36 is rounded to match the outer skirt wall 34 of the closure body 12.

To provide a seal with the upper portion 24 of the dispensing spout 22, the cap 14 includes a tubular sealing bead 38 extending down from the inner surface of the cap wall 36, which is snap received over the upper portion 24 of the dispensing spout 22 to seal the dispensing spout 22 and container closed.

Figure 3:
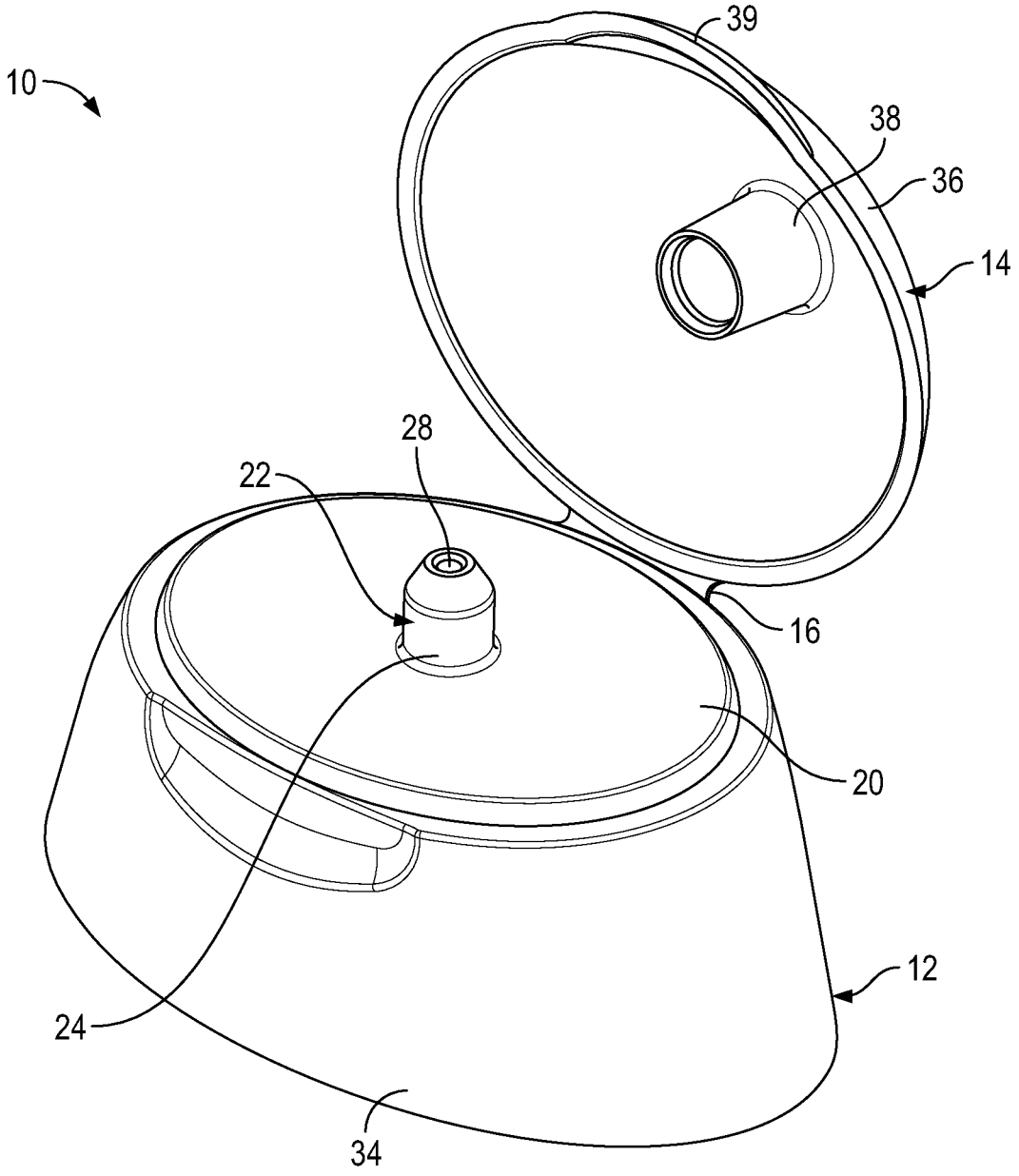
FIG. 3 is another perspective view showing the cap in an open position.
Figure 4:
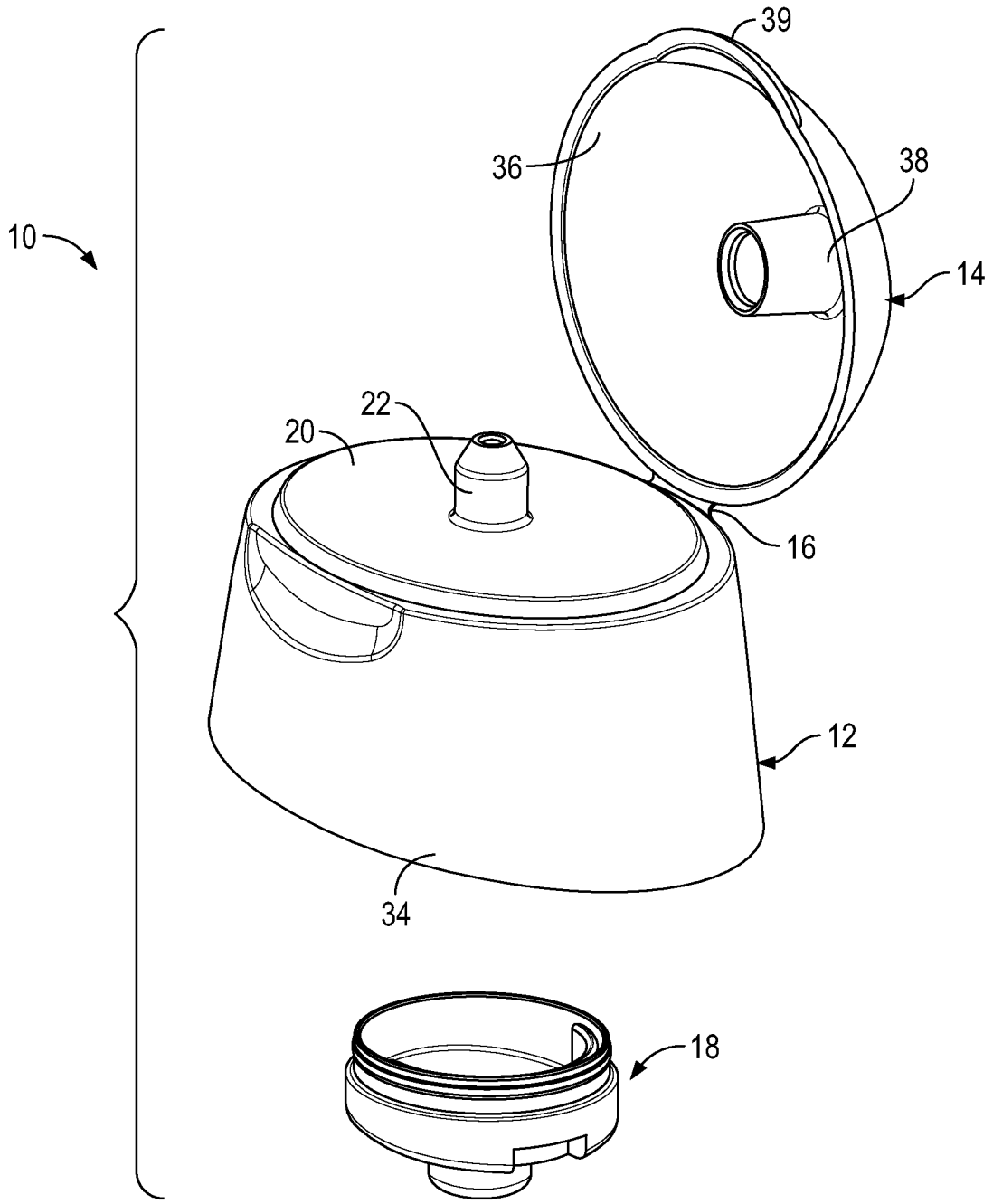
FIG. 4 is an exploded perspective view thereof.
Figure 5:
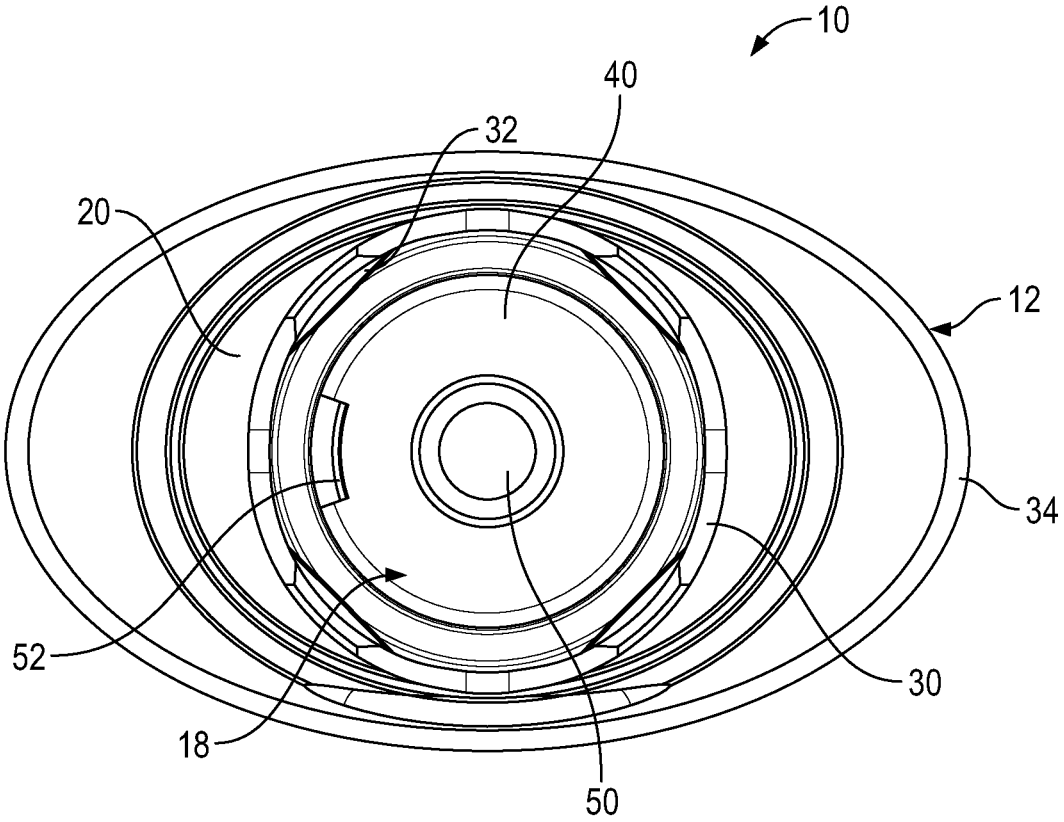
FIG. 5 is a bottom view.

A tab 39 is formed on the front edge of the cap wall 36, opposite the hinge 16, to facilitate movement of the cap 14 from the closed position (FIG. 1) to the open position (FIG. 3).

Figure 10:
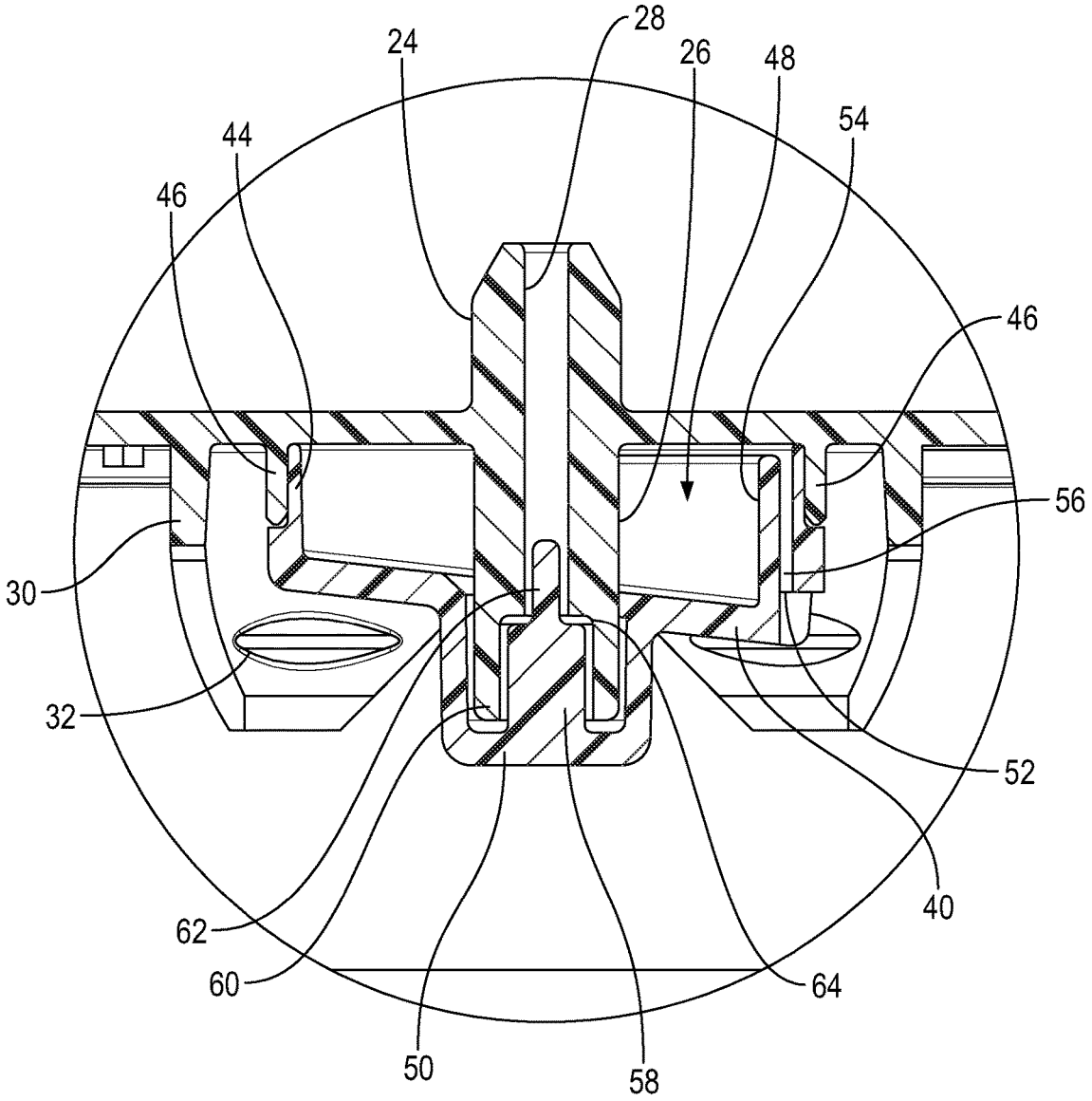
FIG. 10 is an enlargement thereof showing the liquid flow path through the closure.

The flow baffle 18 operates to restrict flow from the container through the flow conduit 28. As can be seen in FIGS. 2 and 6-10, the flow baffle 18 is mounted to the bottom of the closure deck 20 and includes a bottom wall 40, and a side wall 42 having an peripheral upper edge 44 which is snap received with an annular shoulder 46 surrounding the lower portion 26 of the dispensing spout 22. Referring to FIG. 10, it can be more clearly seen that the upper peripheral edge 44 of the baffle side wall 42 and the shoulder 46 include interfitting snap beads which retain the structures together. This assembly forms an interior baffling space 48 within the closure body 12.

Concentrating now on FIGS. 6-10, a fluid well 50 is formed in the center of the bottom wall 40 and a fluid opening 52 is formed on a peripheral edge of the bottom wall 40 to permit fluid to enter the baffling space 48 from the container. The bottom wall 40 of the flow baffle 18 is sloped downwardly towards the fluid opening 52 to permit fluid within the baffling space 48 to drain back into the container when the container is uprighted.

Figure 6:
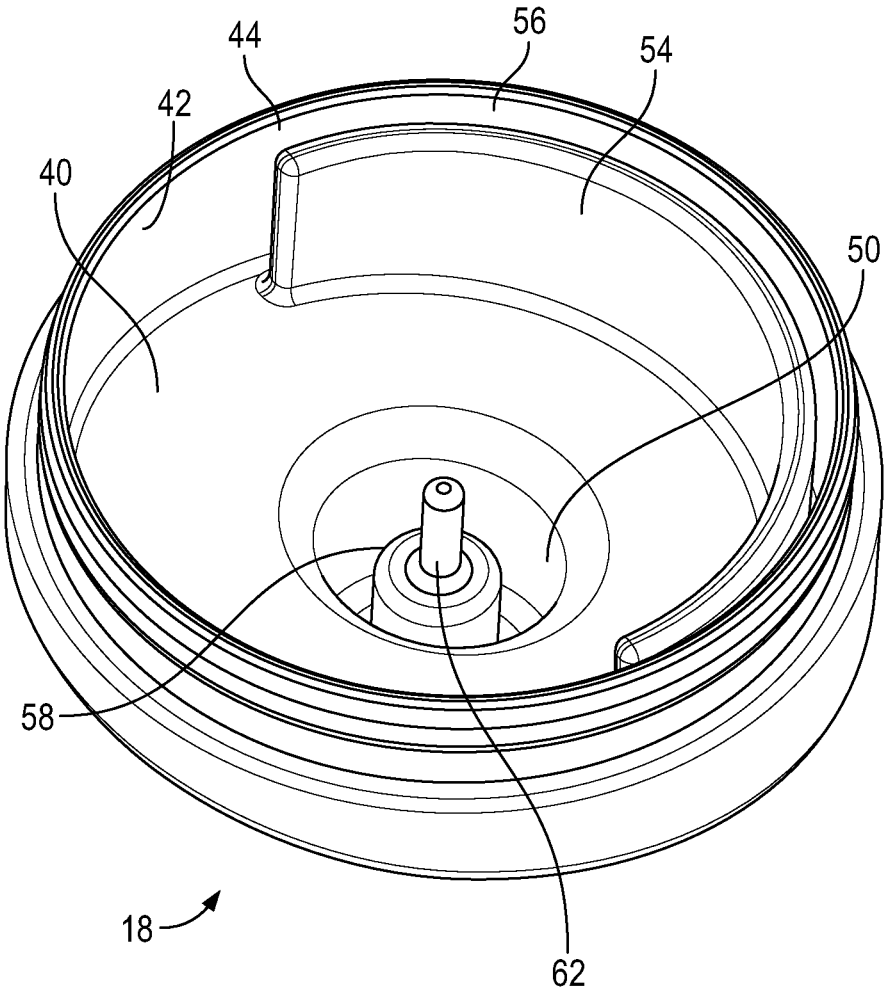
FIG. 6 is a perspective view of the flow baffle.
Figure 7:
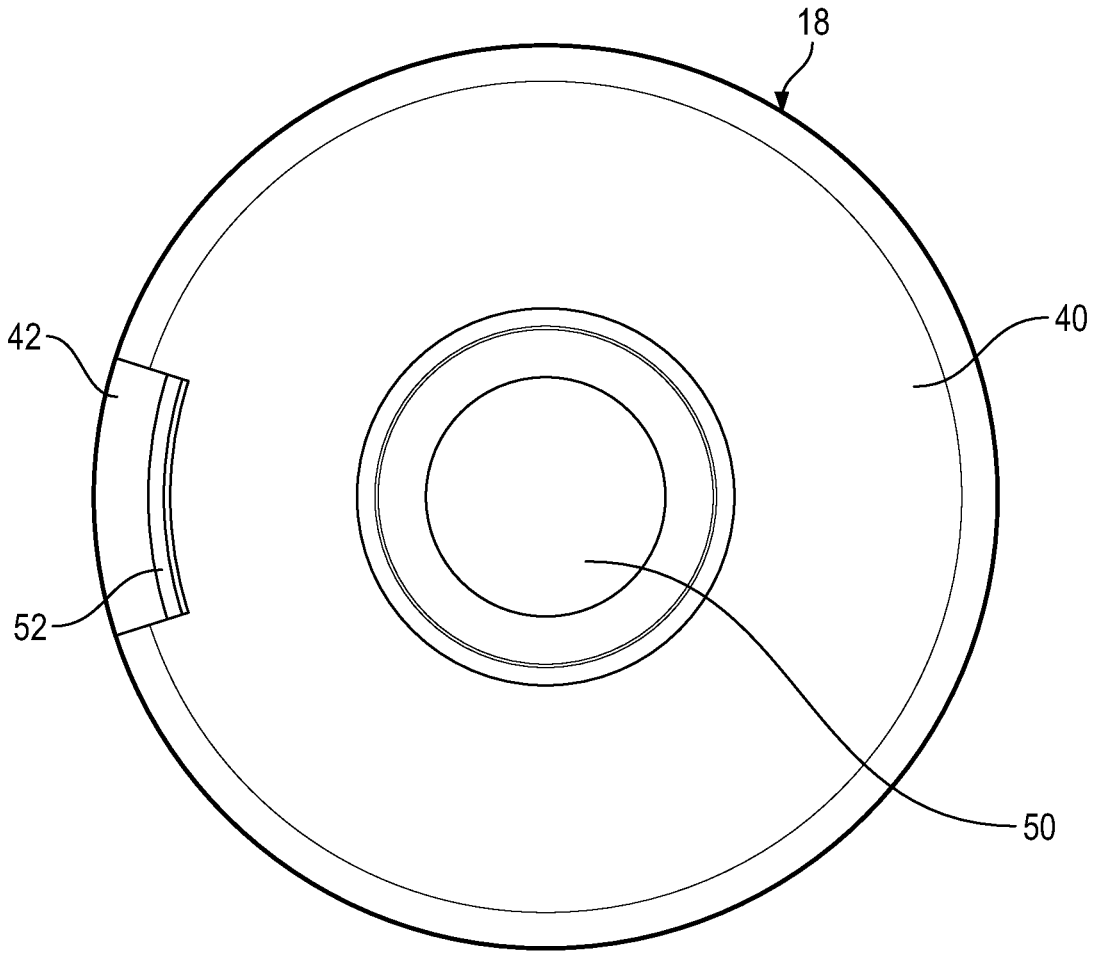
FIG. 7 is a bottom view of the flow baffle.
Figure 8:
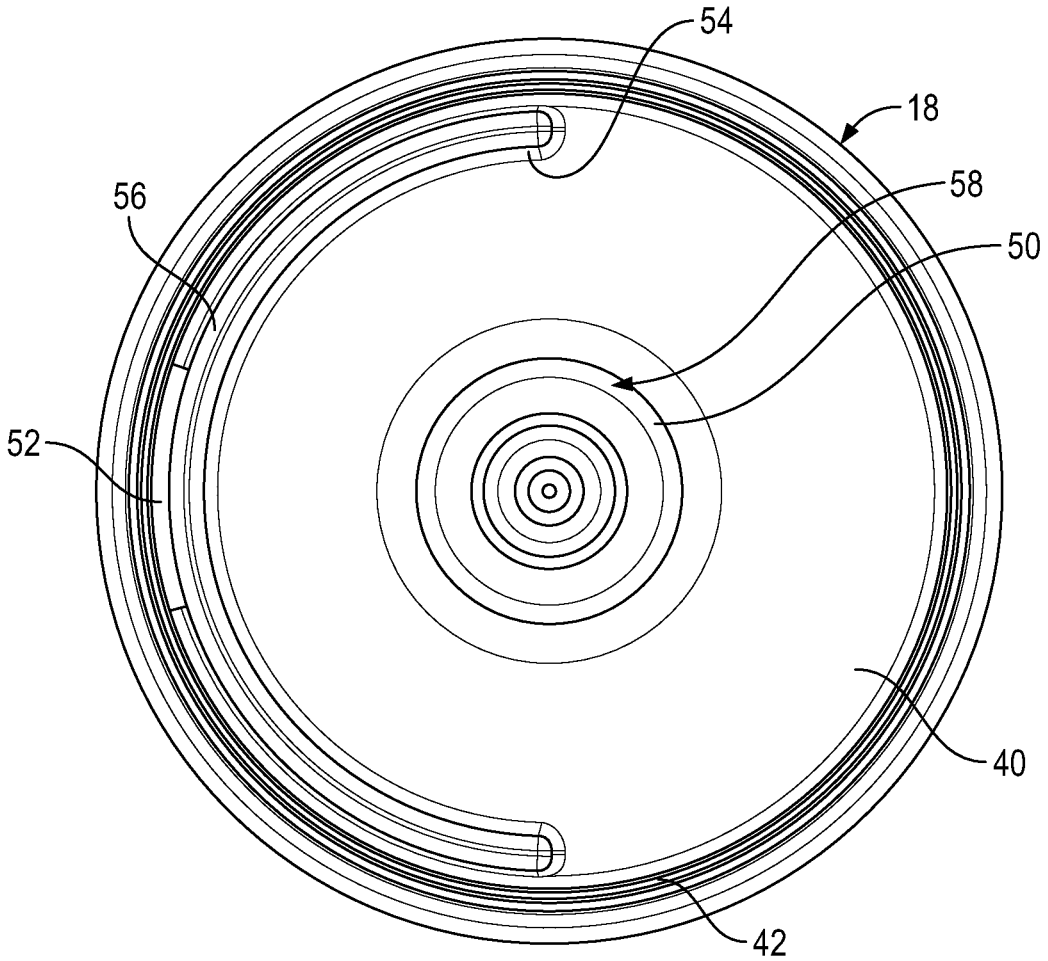
FIG. 8 is a top view of the flow baffle.
Figure 9:
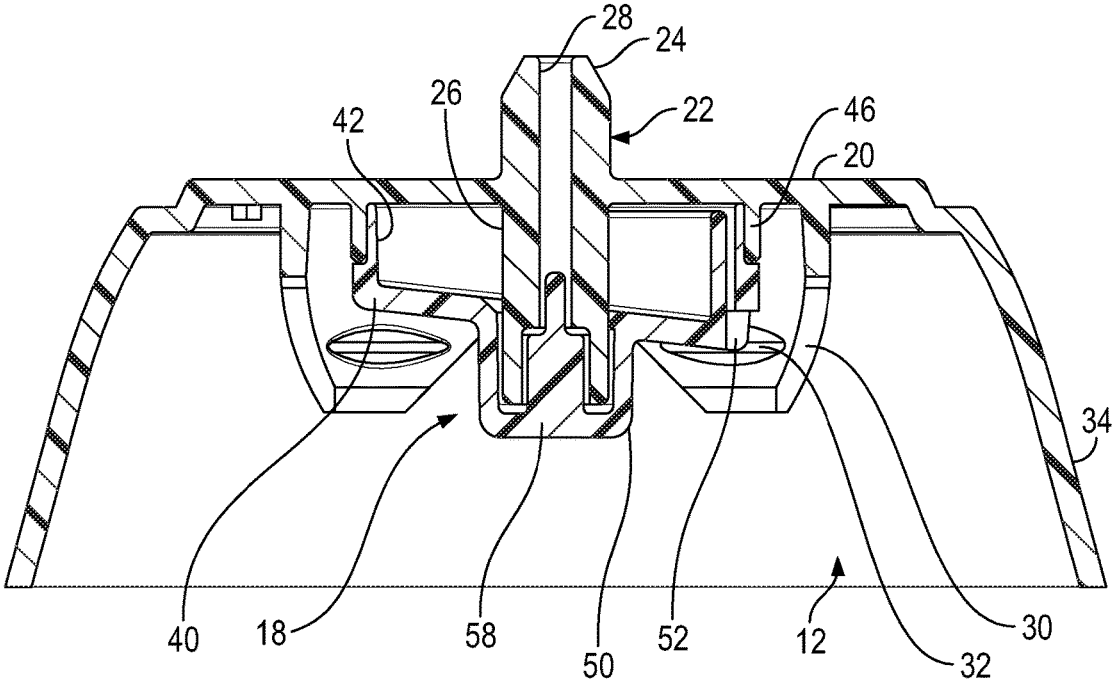
FIG. 9 is a cross-sectional view taken along line 9-9 of FIG. 1.

An arcuate baffling wall 54 extends upwardly from the bottom wall 40 in closely spaced facing relation with the side wall 42 and adjacent the fluid opening 52 and forms an arcuate, restricted flow gap 56 extending from the fluid opening 52 into the baffling space 48 in the interior of the flow baffle 18. The flow gap 56 is best seen in FIGS. 6 and 10. Fluid entering through the opening 52 must past between the baffling wall 54 and the side wall 42 to reach the fluid well 50 inside the baffling space 48.

Additionally, a baffling post 58 extends upwardly from within the fluid well 50 into the flow conduit 28 in the lower portion 26 of the dispensing spout 22 to form a further restricted annular flow passage 60 therebetween. As best seen in FIG. 10, the flow conduit 28 in the lower portion 26 of the dispensing spout 22 and the baffling post 58 have stepped interfitting shoulders 62,64 which create a stepped annular flow passage 60. Also as best seen in FIG. 10, it is pointed out that the outer diameter of the baffling post 58 is smaller than the inner diameter of the flow conduit 28 on both portions of the stepped shoulders 62,64 to provide the restricted annular flow passage 60.

It can therefore be appreciated that the highly restricted flow paths from the interior of the container through the upper portion of the dispensing spout 22 provides a high velocity squirt dispense of the liquid when the container is inverted and squeezed while also providing a clean, no-drip stop of flow when pressure is removed from the container.

While there is shown and described herein certain specific structures embodying various embodiments of the dispensing closure, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A dispensing closure comprising:

a closure body;

a cap;

a hinge structure connecting said cap to said closure body, said cap being hingedly movable between a closed position and an open position; and a flow baffle, said closure body including a closure deck, a tubular dispensing spout having an upper portion extending upwardly from said closure deck and further having a lower portion extending downwardly from said closure deck, said tubular dispensing spout providing a flow conduit from an interior of said closure body to an exterior thereof, an inner skirt wall extending downwardly from said closure deck encircling said lower portion of said dispensing spout, said inner skirt wall including container mounting formations, an outer skirt wall extending downwardly from said closure deck, and an annular shoulder extending downwardly from said closure deck within said inner skirt wall and encircling said lower portion of said dispensing spout, said flow baffle including a bottom wall, a side wall extending upwardly from said bottom wall wherein a peripheral upper edge of said side wall is received in snap fitting engagement with said annular shoulder of said closure body, a fluid well formed in said bottom wall, a fluid opening formed on a peripheral edge of said bottom wall, an arcuate baffling wall extending upwardly from said bottom wall in closely spaced facing relation with said side wall and adjacent said fluid opening and forming a restricted flow gap extending from said fluid opening into an interior of said flow baffle, a baffling post extending upwardly from within said fluid well, said baffling post having an outer diameter which is less than an interior diameter of said flow conduit of said lower portion of said dispensing spout, said baffling post being received within said flow conduit to form a restricted annular flow passage therebetween.

2. The dispensing closure of claim 1 wherein said bottom wall of said flow baffle is sloped downwardly towards said fluid opening to permit fluid within said flow baffle to drain.

3. The dispensing closure of claim 2 wherein said baffling post and said flow conduit within said lower portion of said dispensing spout have stepped interfitting structures thereby creating a stepped annular flow passage.

4. The dispensing closure of claim 1 wherein said baffling post and said flow conduit within said lower portion of said dispensing spout have stepped interfitting structures thereby creating a stepped annular flow passage.

5. The dispensing closure of claim 1 wherein said inner skirt wall is segmented and said container mounting formations comprise thread lugs.

6. The dispensing closure of claim 1 wherein said cap includes a tubular sealing wall which is received over said upper portion of said dispensing spout.

7. The dispensing closure of claim 1 wherein said cap includes a tab to facilitate movement of said cap to said open position.

8. A dispensing closure comprising:
a closure body;
a cap; and
a flow baffle,
said closure body including
a closure deck,
a tubular dispensing spout having a lower portion extending downwardly from said closure deck, said tubular dispensing spout providing a flow conduit from an interior of said closure body to an exterior thereof,
a skirt wall extending downwardly from said closure deck encircling said lower portion of said dispensing spout, said skirt wall including container mounting formations, and
an annular shoulder extending downwardly from said closure deck within said skirt wall and encircling said lower portion of said dispensing spout,
said flow baffle including
a bottom wall,
a side wall extending upwardly from said bottom wall wherein a peripheral upper edge of said side wall is received in snap fitting engagement with said annular shoulder of said closure body,
a fluid well formed in said bottom wall,
a fluid opening formed on a peripheral edge of said bottom wall,
an arcuate baffling wall extending upwardly from said bottom wall in closely spaced facing relation with said side wall and adjacent said fluid opening and forming a flow gap extending from said fluid opening into an interior of said flow baffle,
a baffling post extending upwardly from within said fluid well, said baffling post having an outer diameter which is less than an interior diameter of said flow conduit of said lower portion of said dispensing spout, said baffling post being received within said flow conduit to form an annular flow passage therebetween.

9. The dispensing closure of claim 8 wherein said bottom wall of said flow baffle is sloped downwardly towards said fluid opening to permit fluid within said flow baffle to drain.

10. The dispensing closure of claim 9 wherein said baffling post and said flow conduit within said lower portion of said dispensing spout have stepped interfitting structures thereby creating a stepped annular flow passage.

11. The dispensing closure of claim 8 wherein said baffling post and said flow conduit within said lower portion of said dispensing spout have stepped interfitting structures thereby creating a stepped annular flow passage.

12. The dispensing closure of claim 8 wherein said cap includes a tubular sealing wall which is received over said dispensing spout.

13. The dispensing closure of claim 8 wherein said cap includes a tab to facilitate movement of said cap to said open position.

14. A dispensing closure comprising:
a closure body including
a closure deck, and
a dispensing spout having a lower portion extending downwardly from said closure deck, said dispensing spout providing a flow conduit; and
a flow baffle surrounding said lower portion of said dispensing spout, said flow baffle including
a fluid opening,
a bottom wall,
a fluid well formed in said bottom wall, wherein said fluid opening is formed on a peripheral edge of said bottom wall, and
a baffling post extending upwardly from within said fluid well, said baffling post having an outer diameter which is less than an interior diameter of said flow conduit of said lower portion of said dispensing spout, said baffling post being received within said flow conduit to form a flow passage therebetween,
wherein said flow baffle further includes a side wall, and an arcuate baffling wall in closely spaced facing relation with said side wall and adjacent said fluid opening.

15. The dispensing closure of claim 14 wherein said closure body further comprises an annular shoulder extending downwardly from said closure deck encircling said lower portion of said dispensing spout and said flow baffle further comprises a side wall extending upwardly from said bottom wall wherein a peripheral upper edge of said side wall is received in engagement with said annular shoulder of said closure body.

16. The dispensing closure of claim 14 wherein said bottom wall of said flow baffle is sloped downwardly towards said fluid opening to permit fluid within said flow baffle to drain.

17. The dispensing closure of claim 14 wherein said baffling post and said flow conduit within said lower portion of said dispensing spout have stepped interfitting structures thereby creating a stepped annular flow passage.

* * * * *